US007419459B2

(12) United States Patent
Van Straaten

(10) Patent No.: US 7,419,459 B2
(45) Date of Patent: Sep. 2, 2008

(54) EXERCISE MACHINE

(76) Inventor: Willem Johannes Van Straaten, 130 Trafalgar Place Street, Sandhurst, Sandton (ZA)

( * ) Notice: Subject to any disclaimer, the term of this patent is extended or adjusted under 35 U.S.C. 154(b) by 0 days.

(21) Appl. No.: 11/650,463

(22) Filed: Jan. 8, 2007

(65) Prior Publication Data

US 2007/0179027 A1 Aug. 2, 2007

(30) Foreign Application Priority Data

Jan. 31, 2006 (ZA) ..... 2006/00919
Feb. 27, 2006 (ZA) ..... 2006/01674

(51) Int. Cl.
*A63B 22/00* (2006.01)
*A63B 22/14* (2006.01)

(52) U.S. Cl. ..... 482/70; 482/146; 482/51

(58) Field of Classification Search ..... 482/70–71, 482/51, 146–147, 79–80; 472/29–32
See application file for complete search history.

(56) References Cited

U.S. PATENT DOCUMENTS 3,612,519 A 10/1971 Larson
5,503,609 A * 4/1996 Bull ..... 482/70
5,520,598 A * 5/1996 Little ..... 482/79
5,749,811 A * 5/1998 Wilson ..... 482/71
6,368,254 B1 * 4/2002 Wall ..... 482/71
6,514,180 B1 * 2/2003 Rawls ..... 482/70
6,902,514 B2 * 6/2005 Chuang ..... 482/52
2004/0097337 A1 * 5/2004 Chuang ..... 482/52

FOREIGN PATENT DOCUMENTS

DE 101 20 545 10/2002
DE 203 12 588 10/2003
WO 97/24163 7/1997

OTHER PUBLICATIONS

International Search Report issued Jul. 6, 2007 in the International (PCT) Application of which the present application is the U.S. National Stage.

* cited by examiner

*Primary Examiner*—Fenn C Mathew
(74) *Attorney, Agent, or Firm*—Wenderoth, Lind & Ponack, L.L.P.

(57) ABSTRACT

An exercise machine which includes support structure which is pivotally movable about a main axis and first and second substantially co-planar footpads which are mounted to the support structure and which are movable relatively to the support structure.

5 Claims, 7 Drawing Sheets

92
86
84
88

86
90
90
94
94
80A
82
14
56
50
52
20
56
16
84
80B

72A 66
72B
60B
60A
64
70A
68
70B

EXERCISE MACHINE

BACKGROUND OF THE INVENTION

This invention relates to an exercise machine which is capable of providing a range of exercises for different body parts of a user.

SUMMARY OF THE INVENTION

The invention provides an exercise machine which includes support structure which is pivotally movable about a main axis and first and second substantially co-planar footpads which are mounted to the support structure, and which are movable relatively to the support structure.

The main axis may extend substantially vertically and the footpads may be positioned in a substantially horizontal plane.

The first footpad may be pivotally movable about a first axis. The second footpad may be pivotally movable about a second axis. Pivotal movement of one footpad may be independent of pivotal movement of the other footpad.

The first axis, viewed in plan, may pass through the first footpad. Similarly the second axis, viewed in plan, may pass through the second footpad.

The first footpad may be mounted to a first axle which defines the first axis. Similarly the second footpad may be mounted to a second axle which defines the second axis.

The main axis may be positioned between the first axis and the second axis. The spacing between the first axis and the main axis may substantially equal the spacing between the main axis and the second axis.

The support structure may be of any suitable kind and may for example be in the nature of a plate, a bar, a cross piece or the like.

The exercise machine may include a base and the support structure may be mounted to the base, by means of an axle. The support structure is then pivotal relatively to the base about the axle which is aligned with the main axis.

The base may be floor-engaging, and may be of any suitable shape or form and preferably is circular in plan so that use of the exercise machine is not dependent on the orientation of the base. The support structure may then extend, on opposing sides, from the base. The support structure is preferably close to the floor so that, if it is tipped to one side by the user, an end thereof almost immediately comes into contact with the floor.

Preferably use is made of a cross piece positioned so that outer ends of the cross piece are spaced from an opposing floor surface by no more than 5 cms (2 inches). This spacing can be even less, as low as 1 cm, so that the cross piece cannot move with a rocking action to any significant extent.

The support structure may be mounted to the base via a thrust component which allows pivotal movement of the support structure about the main axis, optionally against a restraining force which is generated by a frictional interaction between the thrust component and the support structure or the base.

In a variation of the invention the footpads are mounted to the support structure for reciprocating movement. In such reciprocating movement the footpads may alternately be moved towards each other and then apart. Each footpad may be reciprocally movable independently of the other footpad. Preferably the footpads are linked so that they are movable in reciprocating fashion in unison. For example the footpads may be linked by means of an endless flexible member, in a loop, which constrains the footpads to move towards each other and then apart, in unison.

The exercise machine may include a handle or any other appropriate arrangement which allows a user to steady himself when standing on the footpads. Preferably a handle which provides support for handgrips extends upwardly from the support structure and at least a lower end of the handle is aligned with the main axis.

A brake or other constraining device may be provided to prevent unwanted movement of the footpads or the support structure or both. The brake may be of a kind which is known in the art and for this reason is not further described herein.

The exercise machine may include one or more resistance devices, preferably of an adjustable nature, connected to the support structure or the footpads, or both, and operable to provide a resistance force which preferably is variable and which acts against movement of the footpads, pivotal or reciprocating, or the support structure, or both, as the case may be. For example at least one elastic member may link the footpads to provide a resistance force which acts against lateral movement of one footpad away from the other footpad.

BRIEF DESCRIPTION OF THE DRAWINGS

The invention is further described by way of examples with reference to the accompanying drawings in which.

DESCRIPTION OF PREFERRED EMBODIMENT

Figure 2:
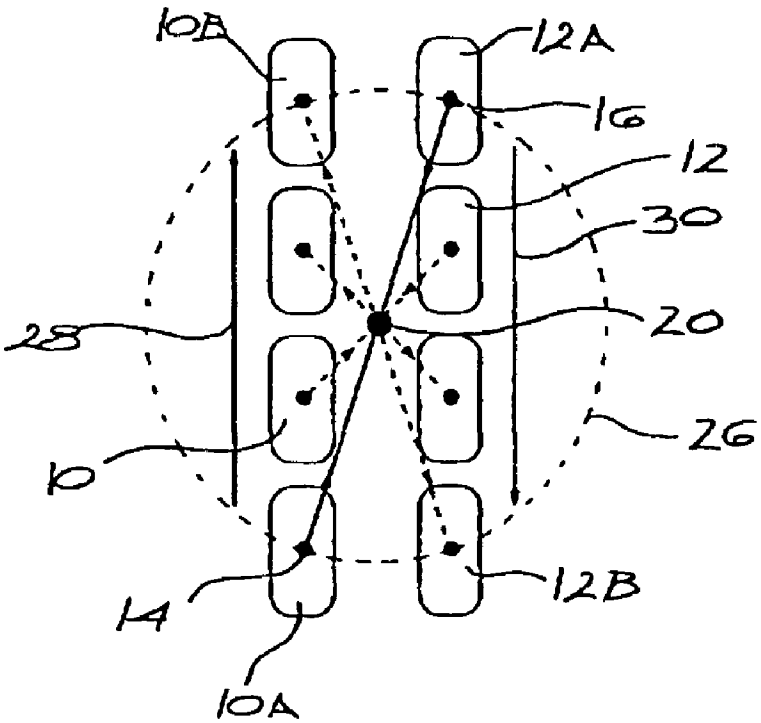
FIGS. 1 and 2 are schematic views illustrating types of movement using an exercise machine according to the invention.
Figure 1:
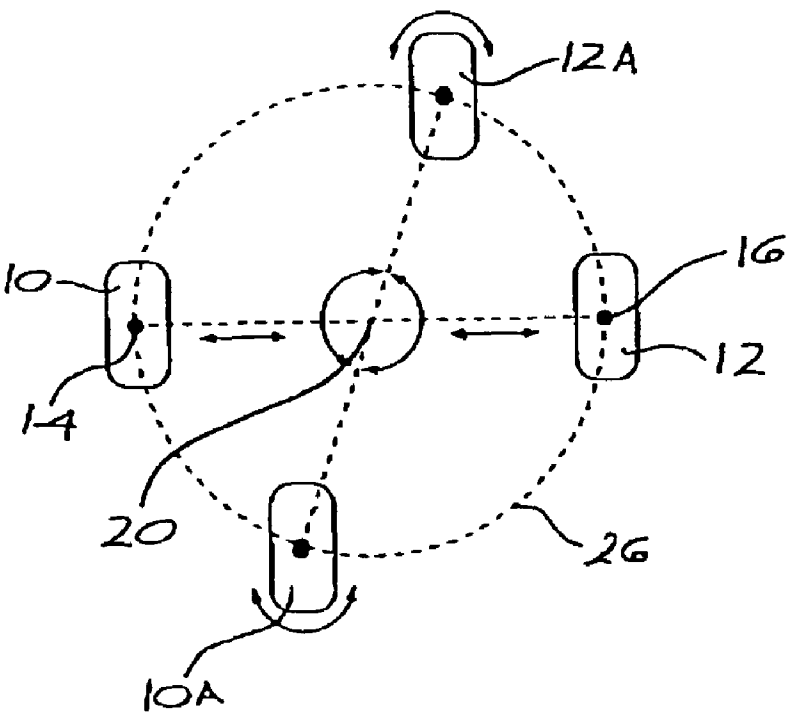

FIGS. 1 and 2 of the accompanying drawings schematically illustrate in plan conceptual aspects embodied in an exercise machine according to the invention.

FIG. 1 illustrates substantially co-planar footpads 10 and 12 respectively which are mounted for pivotal movement to support structure, not shown, about respective axes 14 and 16.

In one mode of movement the footpads are rotationally movable to and fro, about a main substantial vertical axis 20, to positions designated 10A and 12A respectively. The degree of angular movement is determined by a user, not shown. As the footpads are rotated about the axis 20 they are independently pivotal, according to requirement, about the respective axes 14 and 16. The axis 20 is defined by a vertically extending axle and the footpads are movable to the positions 10A and 12A respectively along a circular path 26 which is shown in dotted outline. The radius of the path 26 is preferably variable.

In another mode of use the footpads are movable towards each other i.e. towards the axis 20, and then apart. The footpads may be constrained so that they are movable in unison or they may be movable independently.

FIG. 2 illustrates a mode of use wherein the footpads, respectively initially at positions 10A and 12A, are movable, essentially in straight lines, with a walking "ski-type" action, in directions of arrows 28 and 30 to respective extreme positions 10B and 12B. With this type of movement the distance between the axis 14 and the axis 20, which initially is at a maximum, is reduced and then increased until the distance is again at a maximum. The distance between the axis 20 and the axis 16 varies in a similar way. The length of the path between the footpad portions marked 10A and 10B, and between the footpad positions marked 12A and 12B, respectively, is preferably variable.

Figure 3:
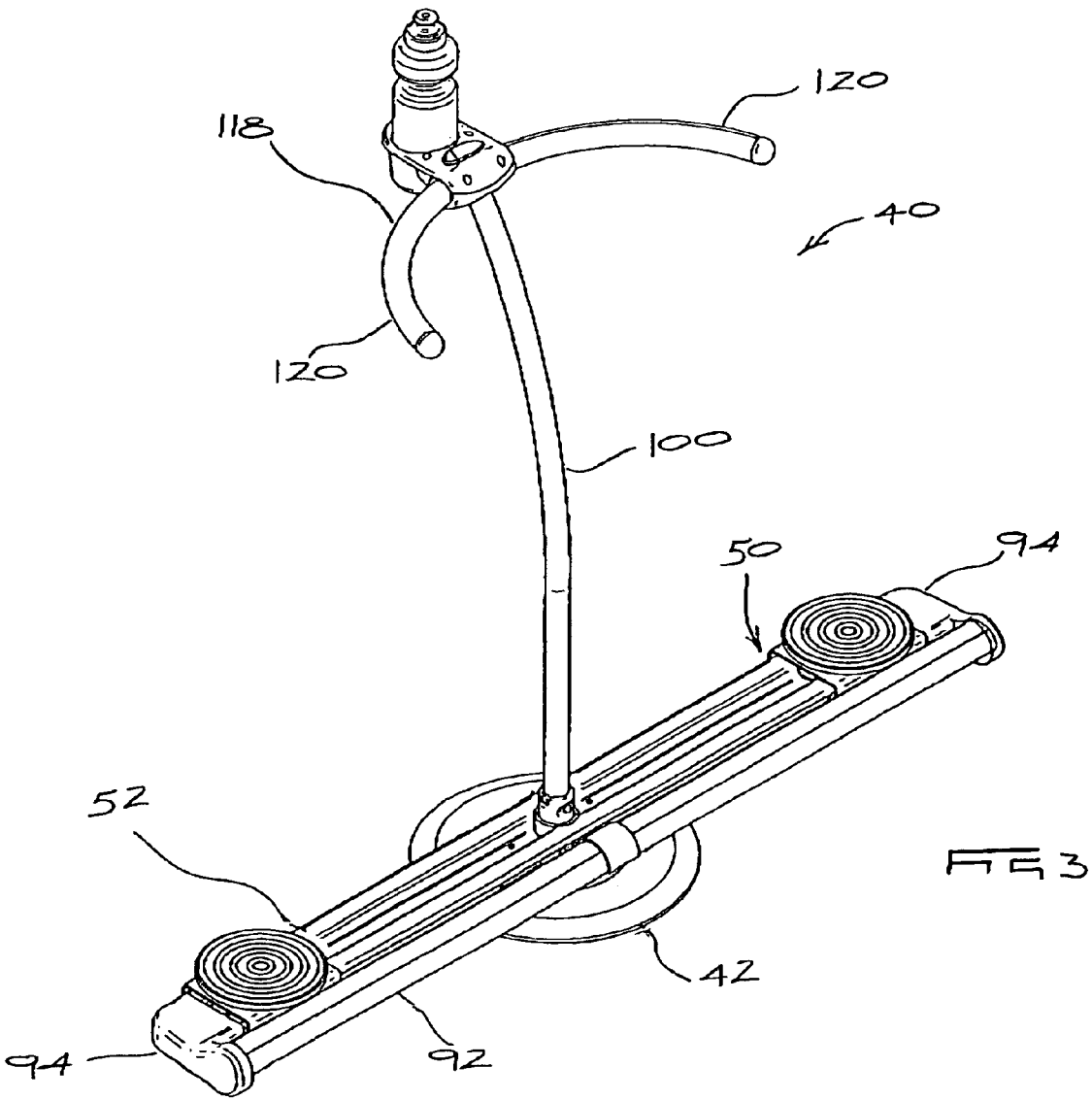
FIG. 3 is a perspective view which shows the physical construction of an exercise machine, according to the invention.
Figure 4:
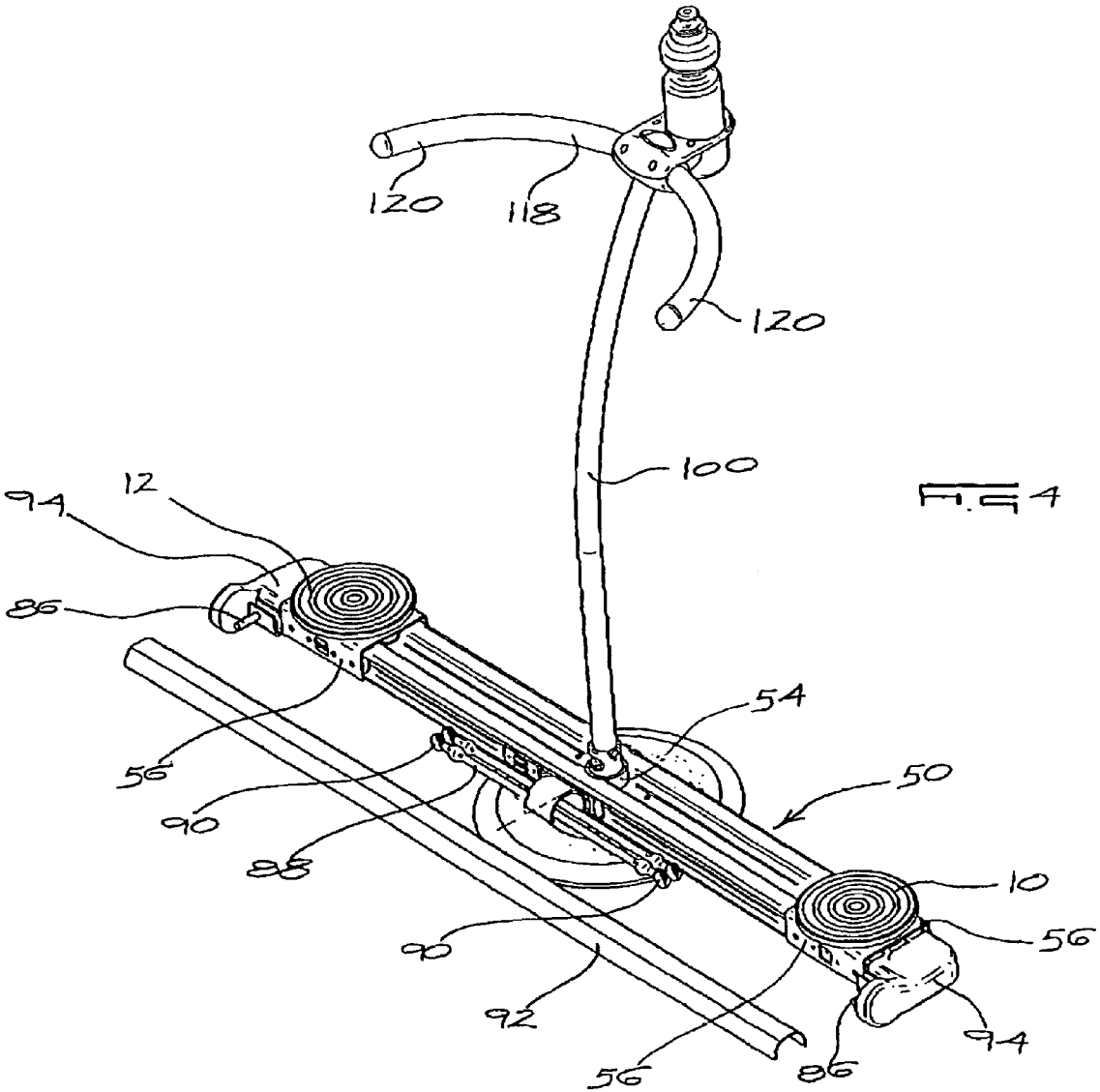
FIG. 4 is a perspective view of the exercise machine with a cover plate removed.
Figure 5:
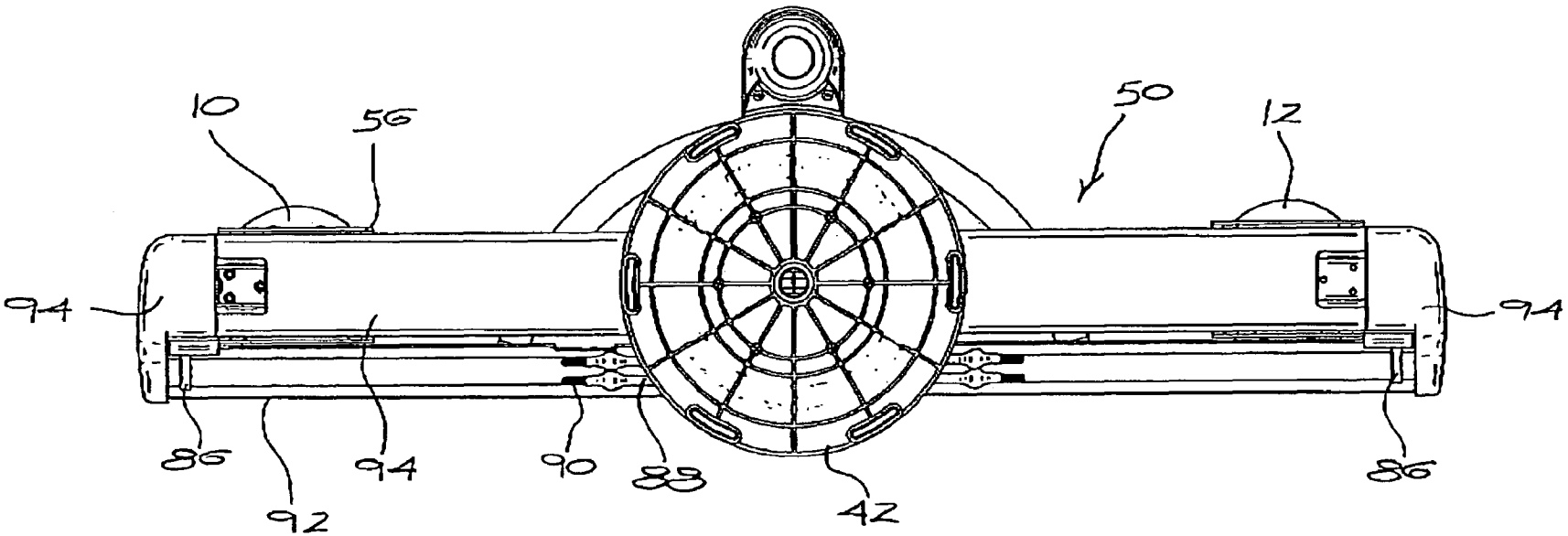
FIG. 5 is an under plan view of the exercise machine.
Figure 9:
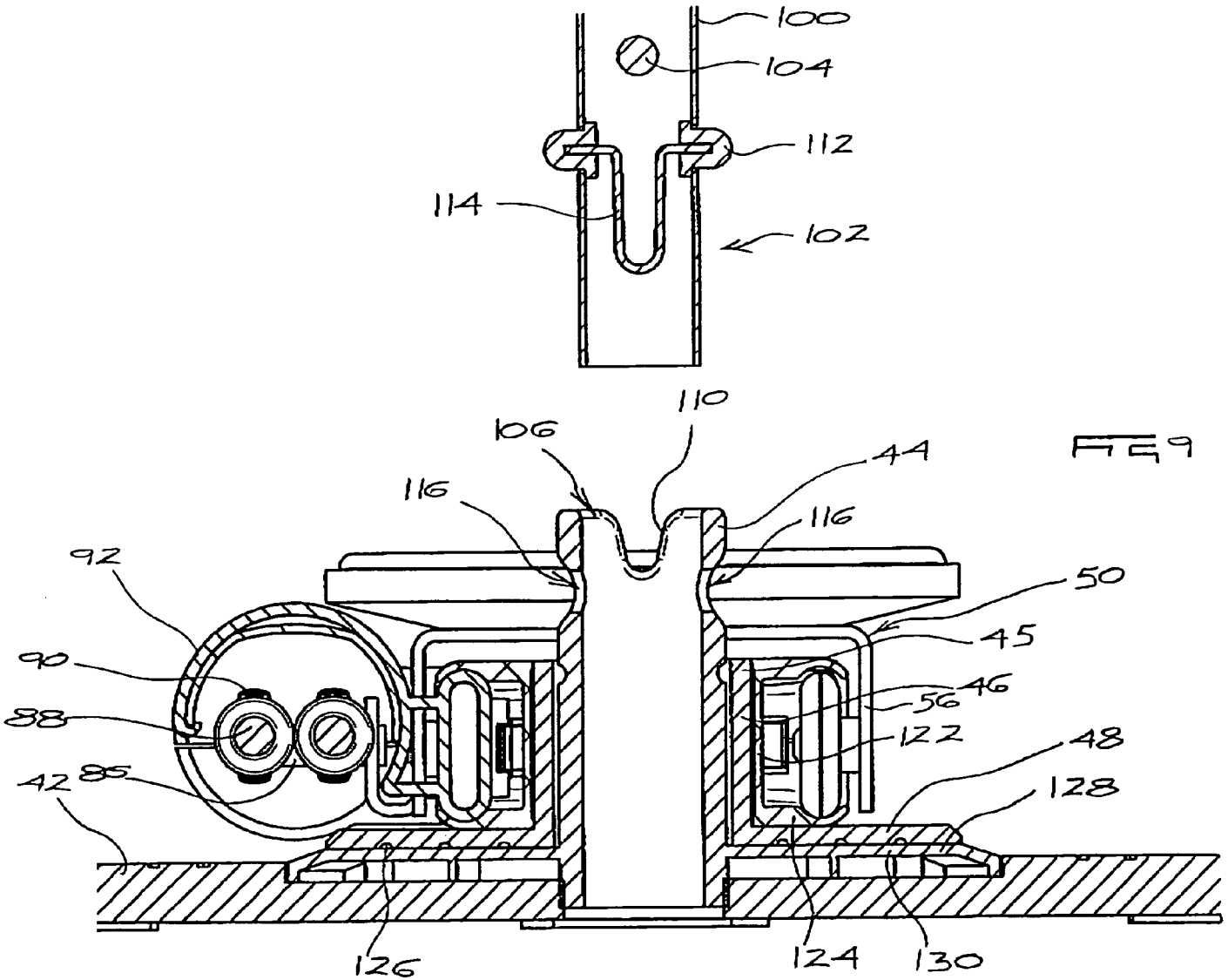

FIGS. 3 to 5 are different views of an exercise machine 40 which gives effect to the principles shown in FIGS. 1 and 2. The machine includes a circular floor-engaging base 42 with a central, upwardly extending tubular hub 44, see FIG. 9, which defines the vertical main axis 20. A thrust component 45 which has a tubular sleeve 46 of complementary shape to the hub and a flared skirt 48, and which is made from a tough plastics material e.g. nylon, is engaged with the hub. Support structure 50 is rotatably mounted to the hub.

Figure 7:
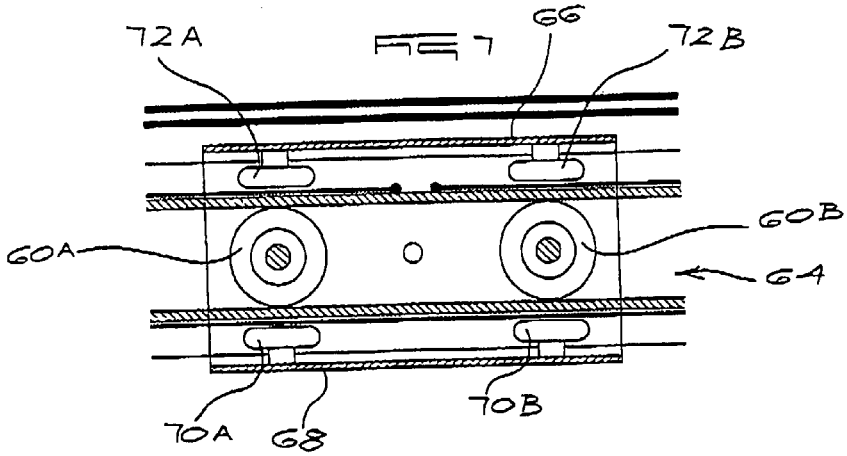
FIG. 7 is a schematic plan view of a carriage, to which a footpad is mounted.
Figure 8:
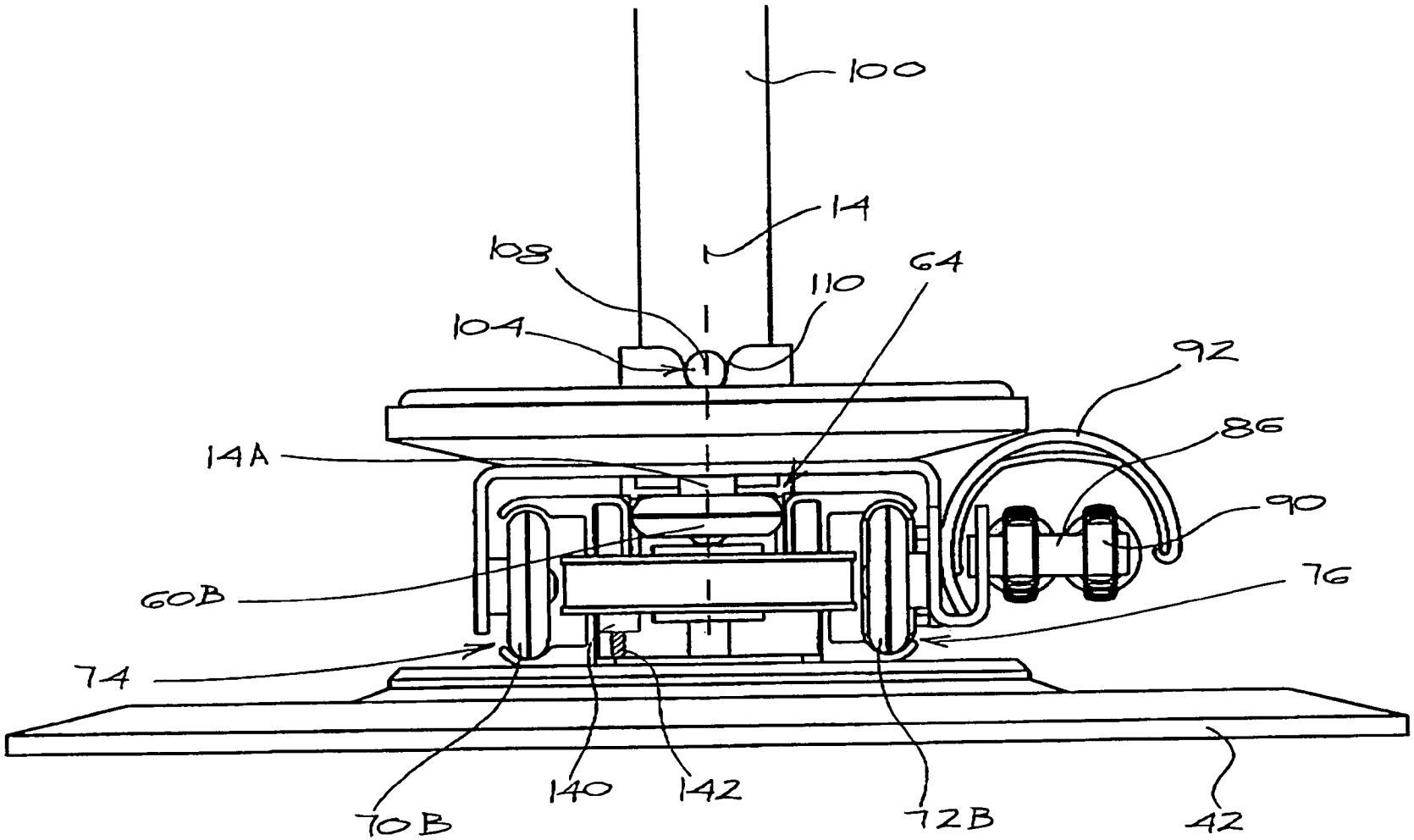
FIGS. 8 and 9 are side views, on an enlarged scale, illustrating mounting details of components of the exercise machine.

The support structure 50 includes a generally horizontal cross piece 52 which has a central circular collar 54 which fits over the hub. The footpads 10 and 12 are mounted in similar ways to the cross piece 52 so that they are substantially co-planar, in a horizontal sense. Only the mounting arrangement for the footpad 10 is described hereinafter the footpad is fixed to a carriage 56 by means of a suitable axle 14A, so that the footpad is pivotally movable relatively to the carriage about its axle which coincides with the axis 14. Two guide wheels 60A and 60B on an underside of the carriage are located in an elongate narrow channel 64 which extends along the length of the cross piece 52 in an upper surface thereof (see FIGS. 7 and 8). Opposed sides 66 and 68 of the carriage have spaced pairs of wheels 70A and 70B, and 72A and 72B, respectively fixed to them. These wheels ride in channels 74 and 76 respectively in longitudinal sides of the cross piece 52.

Figure 6:
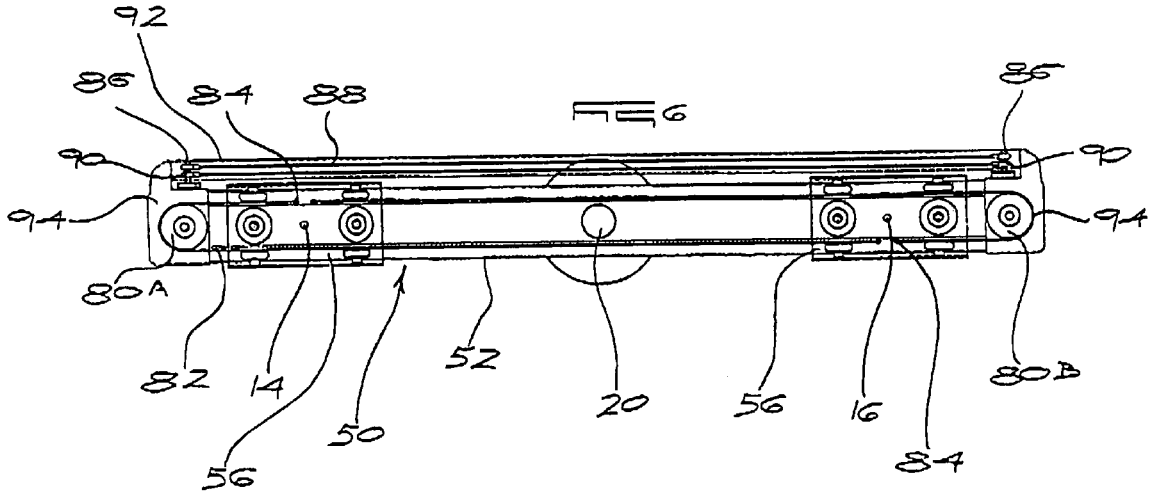
FIG. 6 is a schematic plan view of support structure in the exercise machine.

Pulleys 80A and 80B respectively are positioned at opposing ends of the cross piece 52. An endless cable 82 is looped around the pulleys and is fixed to each carriage 56 at an anchor point 84 (see FIG. 6) in such a way that movement of one carriage causes corresponding movement of the other carriage, and vice versa.

Each carriage has a projecting pin 86 fixed to it. Elastic bands 88, each of which has eyelets 90 at opposed ends of the band, are engageable with the pins, according to requirement, by threading the eyelets 90 onto the pins. Usually the bands are covered by a shroud 92 which clips onto end formations 94 of the cross piece 52.

An upwardly extending handle 100 is centrally mounted to the base, coincidental with the hub 44. A lower end 102 of the handle, which has a pin 104 transversely fixed to it, is inserted into a tubular bore 106 of the hub so that projecting ends 108 of the pin fit into notch formations 110 in the bore. The handle is then locked to the hub by means of retainers 112 which are loaded by a spring 114 and which fit into holes 116 in the hub. In this way at least a lower end of the handle is aligned with the main axis 20.

A curved cross piece 118 is fixed to an upper end of the handle and provides handgrips 120 for a user (not shown) who stands on the exercise machine with his feet on the respective footpads.

The support structure 50, adjacent the circular collar 54, has a tubular section 122 and a transverse portion 124 which respectively closely engage with an outer surface of the sleeve 46, and an upper surface of the skirt 48 of the thrust component.

An underside of the skirt has a number of grooves 126 and is in close sliding contact with a flat surround 128 on a rim 130 of the hub.

The material of the thrust component, and its surface finish, can be varied to change, within limits, the degree of frictional engagement between the support structure 50 and the thrust component, and between the thrust component and the surround 128.

The exercise machine can be used in different ways without any adjustment of the machine being required. In each case a user stands on the footpads and holds the handgrips for balance, and to steady himself particularly when body movement takes place.

In FIG. 4 the footpads (disengaged from the elastic bands) are apart by a maximum extent. When the bands 88 are coupled to the pins 86 lateral movement of the footpads, away from each other, takes place against resistance forces exerted by the bands 88 if the bands. However, if the elastic bands are uncoupled from the footpads, a user can engage in fairly light exercise by "walking" the footpads in straight lines to and fro, through the various positions 10, 10A and 10B, and 12, 12A and 12B, respectively, shown in FIG. 2. This movement is allowed for in that each footpad is pivotal about the cross piece 52, to the extent required, and the cross piece, in turn, is pivotally movable about the main axis 20, first in one direction and then in an opposing direction.

In the movement mode shown in FIG. 1 the substantially co-planar and horizontally disposed footpads 10 and 12 are maintained at a chosen distance from the main axis as the cross piece rotates to and fro about the main axis 20. The footpads pivot relatively to the cross piece so that they remain essentially in parallel orientation to each other.

During the lateral reciprocating movement of the footpads the wheels 70A and 70B, and 72A and 72B, exert a primary guiding function. With the walking-type action shown in FIG. 2 though, the wheels 60A and 60B exert the primary guiding function.

The cross piece 52 is close to the floor, typically with no more than 5 cms (2 inches) between opposing surfaces of the floor and outer ends of the cross piece. Preferably this spacing is less than 2 cm and may be as small as 1 cm (0.4 inch). The user is effectively required to balance on the footpads so that the cross piece is not tilted about the main axis. If however there is a degree of imbalance one end of the cross piece is quickly brought into contact with the floor. This feature restrains the cross piece against rocking and, more importantly, provides support for the cross piece which is then no longer "cantilevered" from the main axis. The strength requirements of the mounting components at the hub of the machine are thereby considerably reduced.

The exercise machine allows a user to exercise in different ways. The handgrips 120, when held by a user, provide stabilising support to the user who may be moving with a twisting action, with the legs moving apart and then together, or with a "walking" action, while using the exercise machine. The cross piece or the handle could be flexible to allow for additional arm and shoulder movement, and exercise. The handle 100 is centrally mounted, in line with the main axis 20 about which the cross piece rotates. This arrangement holds particular benefits in that it allows for a compact assembly of the exercise machine; facilitates engagement of the handle with the base; and provides a strong means of support for a user without restricting the user's motion.

Resistance to divergent lateral movement of the footpads is generated by the elastic bands, the number and stiffness of which can be varied according to requirement. Other mechanisms can be used in place of or in addition to the elastic bands. For example an elongate friction band could pass around a wheel which is fixed to the support structure. As the band tension is increased the degree of frictional braking exerted by a portion of the band which bears against the wheel is increased. This feature allows a user to vary the resistance force which acts against free rotation of the support structure. Another resistance factor could be introduced by engaging a friction brake 140, with adjustable force provided by a spring 142, with each pulley 80A and 80B (see FIG. 8). This brake inhibits lateral movement of the footpads in each direction.

The handle 100 can be disengaged from the hub to facilitate packing and transport of the exercise machine.

The rotational movement of the support structure about the main axis 20 can take place against a resistance device, if required. A reasonable degree of resistance can easily be provided, at minimum cost, by changing the nature, and the surface finish, of the material from which the thrust component 45 is made, thereby to increase or decrease, according to requirement, the frictional "drag" which arises between the support structure and the hub.

The invention claimed is:

1. An exercise machine comprising:

a floor engaging base provided with a hub;

a cross-piece that extends horizontally and is mounted to the hub for pivotal movement about a vertical main axis;

an upwardly extending handle mounted to the base coincident with, and locked to, the hub;

first and second carriages which are mounted to the cross-piece, respectively on opposite sides of the handle, and which are reciprocally movable on the cross-piece; and first and second substantially co-planar foot pads which are mounted to the first and second carriages, respectively and which are pivotally movable about vertically extending axes, respectively, wherein a user, with feet engaged with the foot pads, can exercise in a mode selected, at least, from the following modes:

a first mode in which the cross-piece is rotationally movable, to and fro, about the vertical main axis with each foot pad pivoting about its respective vertical axis;

a second mode in which the foot pads are movable along the cross-piece towards the vertical axis and then apart; and a third mode which is a combination of the first and second modes so that the foot pads are movable, to and fro, in straight parallel lines which are on opposing sides of the vertical main axis and which are a user-determined distance apart.

2. An exercise machine according to claim 1, which includes a flexible elongate member fixed to each carriage so that the carriages are reciprocally movable in unison.

3. An exercise machine according to claim 1, wherein the spacing between opposing surfaces of ends of the cross-piece and a supporting floor surface is less than 5 centimeters.

4. An exercise machine according to claim 1, wherein the cross-piece is pivotally movable about the vertical main axis against a force exerted by a resistance mechanism.

5. An exercise machine according to claim 1, further comprising at least one device, connected to the carriages, for producing a resistance force that acts against movement of the carriages.

* * * * *